United States Patent [19]

Hume

[11] 4,397,133

[45] Aug. 9, 1983

[54] FILL AND SEAL MACHINES

[75] Inventor: Ronald W. Hume, Clearwater, Fla.

[73] Assignee: Lykes Pasco Packing Company, Zephyrhills, Fla.

[21] Appl. No.: 188,839

[22] Filed: Sep. 19, 1980

[51] Int. Cl.[3] ..... B65B 7/28

[52] U.S. Cl. ..... 53/485; 53/313

[58] Field of Search ..... 53/485, 313, 128, 314, 53/316

[56] References Cited

U.S. PATENT DOCUMENTS

| | | | |
|---|---|---|---|
| 2,319,213 | 5/1943 | Davies . | |
| 2,347,668 | 5/1944 | Davies . | |
| 2,352,761 | 7/1944 | Bell . | |
| 2,439,773 | 4/1948 | Hohl et al. . | |
| 2,534,254 | 12/1950 | Felber | 53/485 X |
| 2,805,532 | 9/1957 | Anderson . | |
| 3,029,574 | 4/1962 | Anderson . | |
| 3,078,630 | 2/1963 | Mayer, Jr. et al. . | |
| 3,137,982 | 6/1964 | Decker et al. . | |
| 3,214,887 | 11/1965 | Weller | 53/485 X |
| 3,523,355 | 8/1970 | Schlapkohl | 53/313 X |
| 3,924,384 | 12/1975 | Kinney | 53/485 |
| 3,994,117 | 11/1976 | Kinney . | |
| 4,098,058 | 7/1978 | Carrigan et al. . | |
| 4,168,599 | 9/1979 | King | 53/485 X |

*Primary Examiner*—Willie G. Abercrombie

*Attorney, Agent, or Firm*—Frijouf, Rust & Pyle

[57] ABSTRACT

A fill and seal machine designed to charge liquid products into open-topped containers of predetermined configurations and dimensions and to apply closure members to such containers after the charging operation. An incrementally rotatable carrier disc disposed in communicating relation to a plurality of work stations has a plurality of circumferentially spaced dished portions that communicate with the periphery of the carrier disc, said dished portions successively receiving and transiently retaining individual ones of the containers. A lid delivery assembly for supplying the closure members to conventionally filled containers also provides the lid-sealing function. The novel capping operation is performed by the lid delivery assembly that is angularly disposed at a critical angle relative to the vertical. The filled and sealed containers are removed from the container carrying disc by a passive sweeping arm disposed in path-interruptive relation to such containers.

6 Claims, 6 Drawing Figures fig. 3
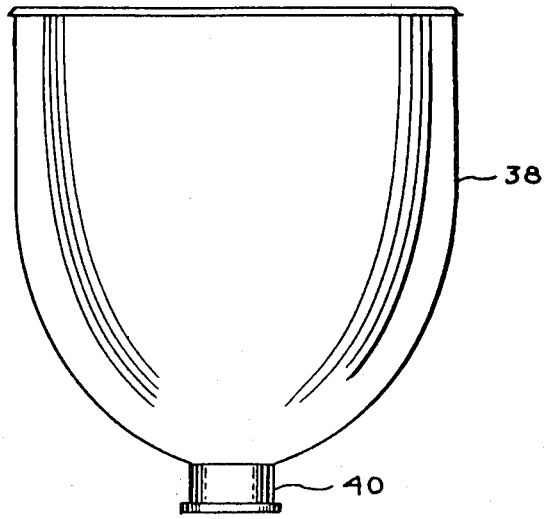
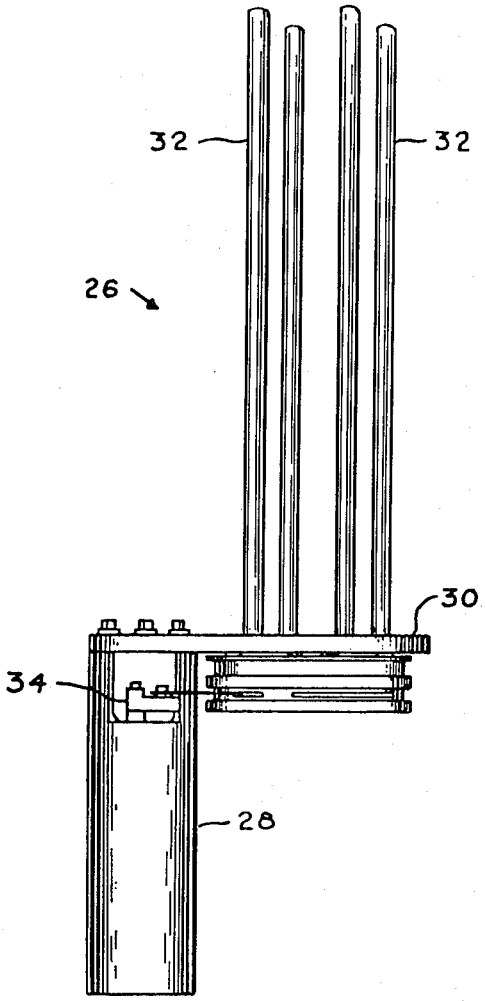
fig. 2
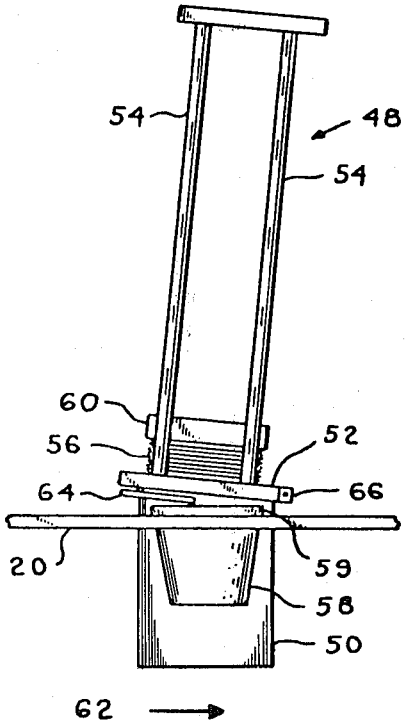
fig. 4

FILL AND SEAL MACHINES

BACKGROUND OF THE INVENTION

1. Field of the Invention

This invention relates generally to machines for filling and sealing containers containing a liquid or semi-liquid product, and more specifically relates to a machine that has a first work station for positioning empty containers for subsequent filling, a second work station for filling the containers, and a third work station for delivering closure members to the filled containers and for sealing said containers with said closure members, and a fourth work station for ejecting the filled and sealed containers from the machine.

2. Description of the Prior Art

Earlier fill and seal machines generally incorporate perforated or apertured turntables, or carrier discs, for transporting the container or cup sought to be filled from work station to work station.

The use of such apertured turntables mandates that a relatively complex cup-ejecting mechanism be used, since the filled and sealed cups must be taken out of registration with the apertures that immobilizes the containers during the fill and seal operation, as a part of the ejection procedure.

Earlier machines in the field of this invention also provide separate work stations for delivering a closure means to an individual cup means on a successive basis and for accomplishing a sealing engagement between said cup and said closure member.

Moreover, earlier machines require a negative pressure source as a part of the lid delivery system, and a heat seal means as a part of the lid sealing system.

The machines of the prior art also incorporate complex drive mechanisms due to the number of work stations and due to the complex active tasks that must be performed at each station.

More specifically, the drive assemblies of the prior art generally include sprocket chains, power take off shafts, and numerous other parts such as cams, cam followers, levers, reciprocating rods and the like.

A need is therefore seen to exist in the packaging industry generally and in the fill and seal machine industry particularly for a machine that has a reduced number of work stations and, accordingly, a reduced number of active components.

SUMMARY OF THE INVENTION

The longstanding but heretofore unfulfilled need for an improved fill and seal machine is now fulfilled by a machine that reduces the number of work stations heretofore found in such machines by combining the lid delivery and lid sealing functions in such a way that such functions are performed substantially simultaneously at a single work station. Further, passive components are employed advantageously to reduce the probabilities of machine malfunction.

The complex cup-ejection systems of the earlier devices is essentially eliminated by the inventive machine, in that the cups are carried from station to station along a predetermined flow path as established by a rotatable turntable that has a plurality of circumferentially spaced pockets formed about the periphery thereof. The pockets are in open communication with the peripheral boundary, so that removal of the cups from the pockets is accomplished when the cups impinge upon a sweep arm member disposed in path-interruptive relation thereto with the attendant rotation of the turntable, the sweep arm guiding the cups to a pick-up area.

The pockets are closed throughout a major portion of each machine cycle by a ring-like element that at least partially surrounds the turntable, in co-planar relation thereto. The ring element imparts stability to the cups during the fill and seal procedure. The ring element is discontinuous adjacent the cup-discharge region of the machine, so that the sweep arm member can discharge the filled and sealed cups.

The lid delivery/lid sealing work station includes a lid or closure magazine having a frame structure for transiently retaining a supply of lids in stacked relation. The frame structure is disposed generally in aligned relation to the various cup-carrying pockets formed in the periphery of the turntable. The longitudinal axis of the generally upstanding frame structure is angularly offset from the vertical by about 7°. As the bottommost lid in the stack of lids held by the frame structure exits therefrom under the influence of gravity, a specifically disposed finger element interrupts the fall of the lid and supportingly engages the peripheral boundary of the lid. The finger element is orthogonally disposed relative to the longitudinal axis of the frame structure so that a lid resting partially thereon is tilted an 83° angle relative to the horizontal. The lip, or rim, portion of the cup requiring closure rotates into registration with the lowermost portion of the tilted lid, and a partial snap-fit engagement therebetween is effected. Continued rotation of the turntable and hence continued angular rotation of the cup completes the closure procedure in that such rotation causes the yieldable lid means to impinge upon a non-yieldable roller means that acts to snap-fittingly engage the remainder of the cup and lid in a generally wiping-type motion.

The turntable and the operable components of the respective work stations are driven by a drive assembly that includes a power source in the form of an electric motor, a gear reduction means disposed in driven relation to the motor means, and a novel gear train that is characterized at least in part by having the individual gears that collectively form the gear train disposed in substantially unidirectional alignment with one another. Only three gears are needed to operate the geneva mechanism that rotates the turntable as required and the operable components of the work stations.

It is therefore seen to be an important object of this invention to provide an improved fill and seal machine having a reduced number of work stations.

More specifically, it is an object of this invention to provide a fill and seal machine having only two work stations with active components, and two work stations with passive components.

A closely related object is to provide such a machine having a simplified drive assembly.

A very important object is to provide such a machine wherein the lid delivery and lid seal function is performed at a single work station.

Still another object is to provide a lid sealing means that harnesses the kinetic energy of a rotating turntable to apply a yieldable lid means to a cup in snap-fit engagement therewith.

Yet another object is to harness such turntable motion to effectuate ejection of filled and sealed cups from the machine.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings in which:

FIG. 2 is a side elevational view of the cup delivery, or cup drop work station.

FIG. 3 is a side elevational view of the liquid reservoir which forms a part of the cup filling work station.

FIG. 4 is a side elevational view of the lid delivery and lid sealing work station.

Similar reference numerals refer to similar parts throughout the several views of the drawings.

DETAILED DESCRIPTION OF THE PREFERRED EMBODIMENT

Figure 1:
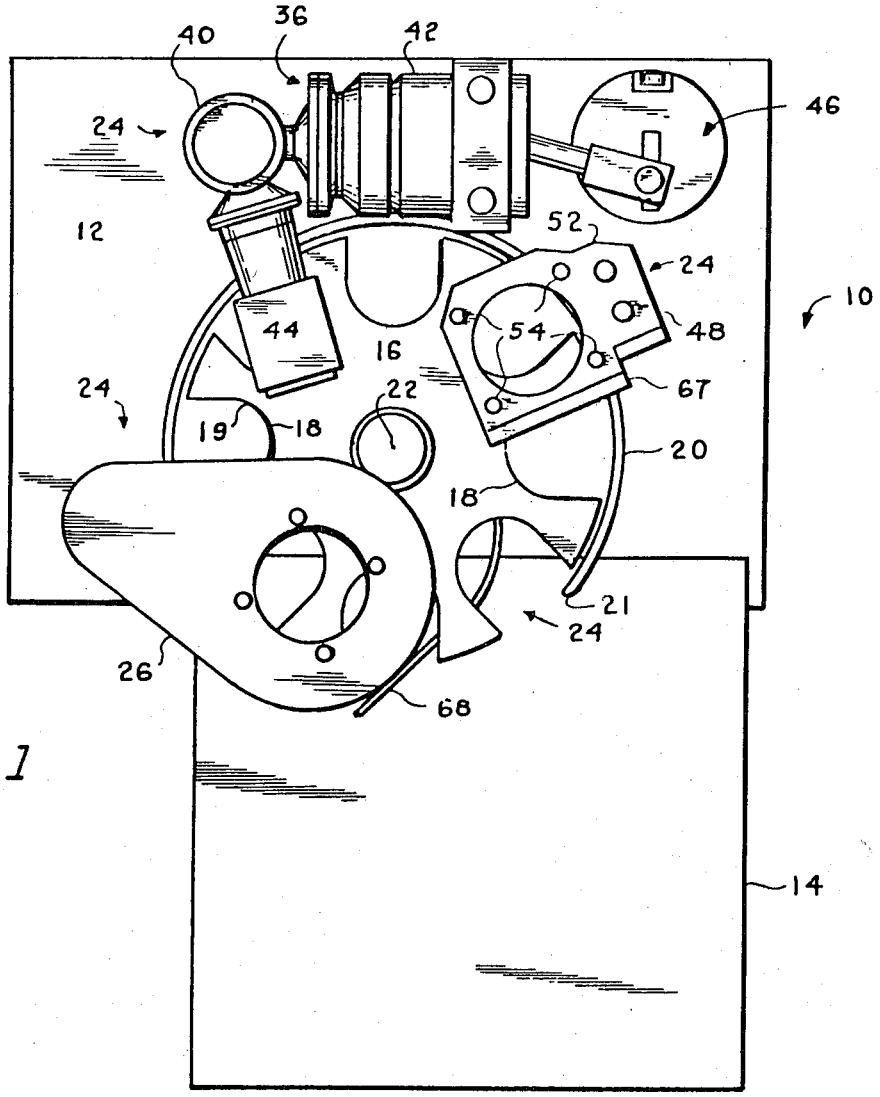
FIG. 1 is a top plan view of the preferred embodiment of the invention.
Figure 6:
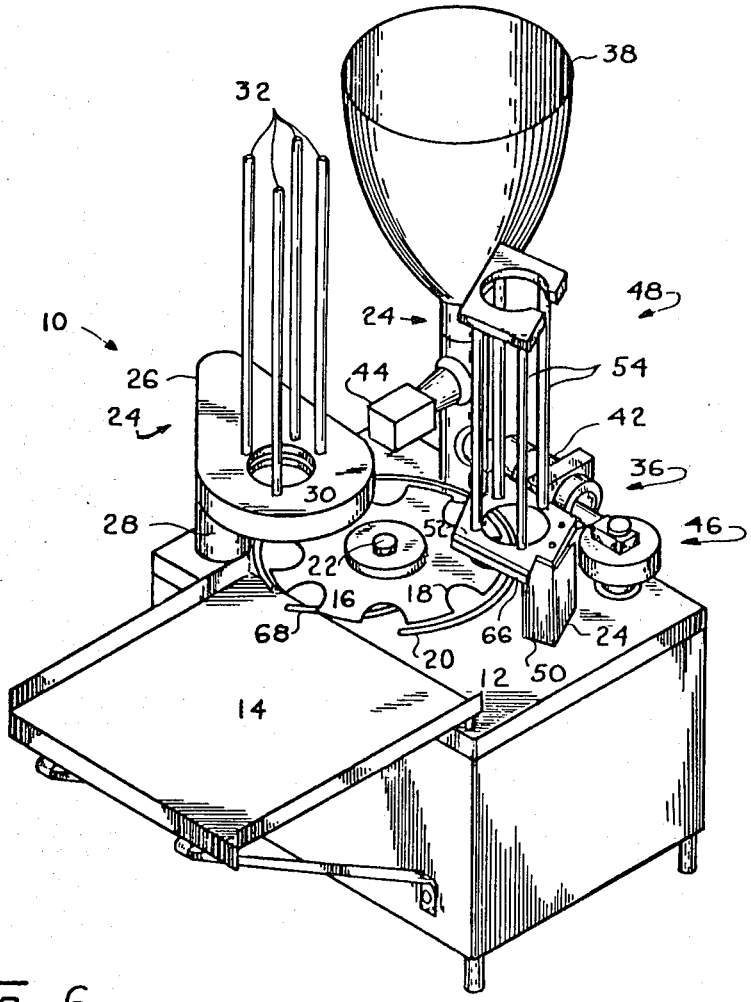
FIG. 6 is a perspective view of the preferred embodiment of the invention.

A major portion of the inventive assembly is shown in top plan view in FIG. 1 and is designated 10 as a whole. A top plate 12 of the machine housing is preferably rectangular, flat, and disposed substantially in a horizontal plane. A discharge chute 14 is parallel to but vertically offset from the plate 12, as best shown in FIG. 6.

A drive assembly, hereinafter described, for the inventive machine 10 is disposed below the plane of the top plate 12 and is housed within the remainder of a box-like machine housing, not shown.

A carrier means or turntable 16 is spaced upwardly of the plane of the top plate 12, in substantially parallel relation thereto. The turntable 16 has a circular peripheral boundary and a plurality of equi-distant, circumferentially spaced, radially disposed cut-out apertures, or pockets 18. The pockets 18 are in open communication with the peripheral boundary of the turntable, and are specifically configured and dimensioned to correspond in size and shape to the cups that are filled and sealed by the inventive machine, so that said cups are supportingly engaged about their respective rims at least in part by the interior edges 19 of the pockets 18.

A stationary, dis-continuous ring element 20 partially surrounds the turntable 16, as shown in FIG. 1, and is co-planar therewith.

The turntable 16 is removably mounted to the machine housing, and is rotatable about an axis 22. A geneva mechanism, not shown, effects timed rotation of the turntable 16 in 45° increments, there being eight (8) cup-carrying pockets 18 formed in the turntable 16 in the preferred embodiment of the invention.

A plurality of work stations, collectively designated 24, are disposed in circumferential relation to one another about the periphery of the turntable 16, so that the operable components of each of the work stations are in communicating relation to different ones of the pockets 18, as depicted in FIG. 1. More specifically, at the completion of each incremental advance of the turntable 16, different ones of the pockets 18 are in vertically-spaced axial alignment with the operable components of different ones of the work stations 24.

The first work station, designated 26, conventionally supplies a container or cup to an aligned pocket 18 attendant each incremental advance of turntable 16. As shown in FIG. 2, the cup delivery work station 26 includes an upstanding support member 28 that is fixedly secured to the top plate 12 of the machine housing. An arm 30 is disposed in overhanging relation to the turntable 16 by a cantilever-type attachment to the support member 28. A plurality, preferably four (4), of upstanding arms 32 are provided to retain a supply of cups or containers in stacked, internesting relation in the area bordered by said arms 32. The mechanism 34 for successively depositing the cups into the respective pockets 18 is known to those skilled in the pertinent art.

In the embodiment of the invention that is depicted in FIG. 1, the turntable 16 is driven so that it undergoes dextrorotation. Accordingly, a cup deposited in a pocket 18 by the cup drop work station 26 is transported by the turntable 16 to a point in communication with the second work station, wherein a liquid or semi-liquid product is charged into the cup. The means for filling the cup at this work station is an essentially conventional pumping means, designated 36 as a whole. A liquid reservoir 38, shown in FIG. 3, is mounted in upstanding disposition with an outlet 40, as best shown in FIG. 1, being in fluid communication with a reciprocating piston-type pump means, generally indicated as 42, and a head, or discharge spout 44. A pair of one-way valves, not shown, prevent reverse flow of the product. The amount of liquid pumped into each cup is a function of the length of the stroke of the pump's piston (not shown), and a micro-adjustment means, generally indicated as 46, is provided so that the length of the piston stroke can be finetuned to meet specific dosage requirements.

The filled cup is next carried by the turntable 16 to the third work station which is designated 48 as a whole. At this work station, the lids or closures are supplied to each cup, on a successive basis, and are releasably attached thereto. The third work station 48 includes an upstanding support member 50, an arm 52 attached thereto in cantilever fashion to overhang the periphery of the turntable 16. A plurality of upstanding lid retainer members 54 extend from cantilever arm 52 and are collectively arrayed to provide a gravity fed, closure magazine to supply closure members or lids 56 for the containers 58. A block 60 of adequate predetermined mass rests atop the generally vertical stack of lids 56 to enhance the gravity-influenced discharge of successive lids 56 from the magazine 54.

As shown clearly in FIG. 4, the cantilever arm 52 is obliquely disposed relative to the turntable 16 so that the lid retaining assembly 54 disposed in orthogonal relation to the arm 52 are tilted from the vertical. Empirical studies have shown that the optimal amount of angular rotation of the lid retaining assembly 54 from the vertical is seven (7) degrees, although the amount of tilt can range from 5°–10° from the vertical.

As shown in FIG. 4, the turntable 16 is rotating from left to right, as indicated by the directional arrow 62. A cup 58 is shown just prior to the moment when a lid 56 is dropped thereon. The cup 58 is supportedly engaged about a container rim 59 by the interior edges 19 of the pocket 18 and by an adjacent portion of the ring element 20.

A tilt-maintaining finger element 64 is attached to the cantilever arm 52 and lies in a plane parallel to the obliquely-disposed plane of the arm 52. The finger element 64 projects into the path of free fall of the individual lids 56 and supportingly engages, on a transient basis, a portion of each lid 56 sufficient to retain such lid 56 in an inclined position, even after such lid 56 has separated from the lid stack. When one portion of a lid 56 is supportingly engaged by the finger element 64, a diametrically opposed portion thereof will engage the rim 59 of the cup 58. When the turntable 16 again advances, the inclined lid 56 travels into impinging relationship with a roller means 66 that is rotatably and non-translatably mounted on the cantilever arm 52 at edge 67. The roller means 66 has a length at least equal to the diameter of the cup lids 56 and is disposed in transverse relation to the direction of turntable 16 rotation. The lid 56 is made of substantially flexible materials, and accordingly yields to the roller means 66 attendant continued rotation of the turntable 16. Such yielding action on the part of the lid 56 causes the lid to conform to and snap-fittingly engage the cup 58 about the uppermost periphery of rim 59, thereby effectively sealing the cup 58 against spillage of the liquid (not shown) retained therein.

The above-described coining operation can also be accomplished, although less advantageously, by providing a stationary, non-rotatable wiper blade (not shown) in lieu of the preferred roller means.

Returning now to FIG. 1, it will be noted that a filled and sealed cup 58 exiting the capping work station 48 encounters the dis-continuous portion 21 of the ring element 20 and is thereby at least partially dis-engaged from pocket 18. A fixed-position sweep arm 68 is disposed downwardly of the turntable 16 and upwardly of the top plate and discharge chute 12 and 14, respectively, for guiding successive cups 58 out of the respective pockets 18 and onto the discharge chute 14 to be collected by the machine operator.

Figure 5:
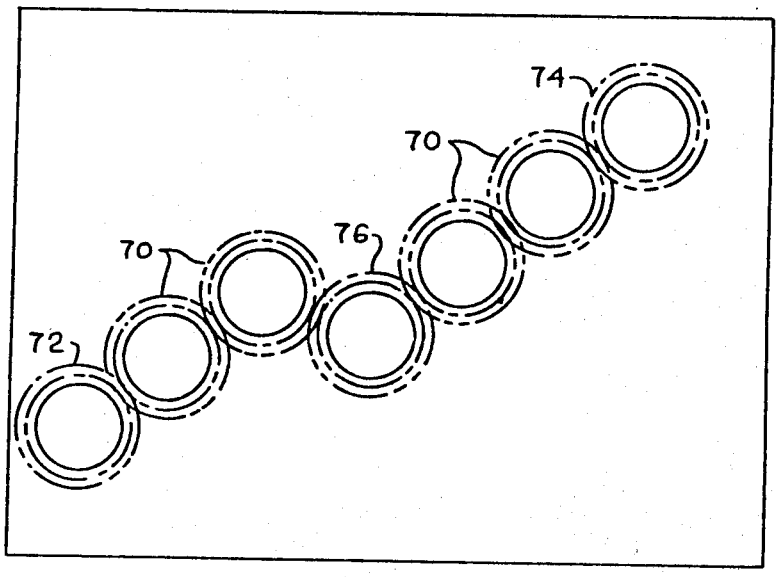
FIG. 5 is a diagrammatic plan view of the inventive gear train that forms a part of the drive assembly for the preferred embodiment.

The novel gear train for the inventive machine is shown, diagrammatically, in FIG. 5. Four (4) of the seven (7) gears are idlers, and are collectively designated 70. The outermost gears, 72 and 74, are connected in driving relation to the pump 42 and the first work station 26, respectively. The centrally-disposed gear 76 is the main drive gear and is is connected in driven relation to a power supply means in the form of an electric motor (not shown).

The eight (8) position geneva mechanism (not shown) and the turntable 16 are connected in driven relation to the main gear 76.

The only active components of the entire assembly are thus seen to be the first work station 26, second work station 42, and the turntable 16. The lid delivery and lid sealing means 48, as well as the filled and sealed cup ejection means 68 are essentially passive components. The complex drive assemblies of earlier fill and seal machines have accordingly been eliminated and the probabilities of machine malfunction have been sharply and inventively curtailed.

It will thus be seen that the objects set forth above, and those made apparent by the foregoing description, are efficiently attained, and since certain changes may be made in the above construction without departing from the scope of the invention, it is intended that all matters contained in the foregoing description, or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

That which is claimed is:

1. A machine for successively charging a plurality of containers with a predetermined quantity of fluid and for sealingly attaching closures to the containers to inhibit spilling of the fluid, comprising:

a machine housing;

a first, second and third work station disposed along a predetermined path relative to said machine housing;

carrier means for carrying the containers in timed sequence between said work stations;

said first work station including means for successively delivering individual containers to said carrier means;

said second work station including means for successively charging individual containers with a predetermined quantity of fluid;

said third work station includes a gravity feed for successively supplying closures to the containers and means for sealingly attaching the closures to the containers;

said third work station comprising a fixed position closure magazine for retaining a plurality of closures in a stacked relationship with one closure resting upon another closure;

means establishing the longitudinal axis of said closure magazine at a relatively small angle relative to the vertical with the lowermost portion of the bottom closure in said closure magazine being in path-interruptive relation with the uppermost portion of the container on said carrier means; and said uppermost portion of the container engaging the stationary lowermost portion of the bottom closure enabling the closure to be withdrawn from said closure magazine and to be secured to the container upon movement of the container by said carrier means.

2. The machine of claim 1, wherein said closure magazine further comprises a finger element disposed in the discharge end of said closure magazine enabling successive closures to be transiently supported by said finger element; and said finger element transiently maintaining the closures in an angular disposition relative to the vertical enabling the closures to be correctly positioned in path-interruptive relation with the uppermost portion of the container.

3. The machine of claim 1, including sealing means disposed in path interruptive relation to said bottom closure having the lowermost portion thereof engaged to said uppermost portion of the container enabling the closure to be totally sealed to the container upon movement of the container by said carrier means.

4. A machine as set forth in claim 3, wherein said sealing means disposed in path-interruptive relation to said bottom closure lid having a portion thereof engaged to said uppermost portion of the container includes roller means.

5. The machine of claim 1, wherein the closures are maintained by said closure magazine at an angular disposition between 5–10 degrees from the vertical.

6. The machine of claim 5, wherein the closures are maintained by said closure magazine at an angular disposition of seven degrees from the vertical.

* * * * *